United States Patent [19]

Lee

[11] Patent Number: 4,998,360

[45] Date of Patent: Mar. 12, 1991

[54] PORTABLE IRONING PRESS INCLUDING CHAIN, GEAR, AND SPRING ARRANGEMENT, FOR PRESSING ARTICLES

[75] Inventor: Hee K. Lee, Seoul, Rep. of Korea

[73] Assignee: Brother International Corporation, Somerset, N.J.

[21] Appl. No.: 488,657

[22] Filed: Mar. 5, 1990

[30] Foreign Application Priority Data

Jan. 16, 1990 [KR] Rep. of Korea ..... 1990-426

[51] Int. Cl.[5] ..... D06F 71/10; D06F 71/36; D06F 71/00

[52] U.S. Cl. ..... 38/36; 38/1 B; 38/17; 38/19; 38/25; 38/26; 38/27; 38/28; 38/30; 38/34; 38/43

[58] Field of Search ..... 38/1 B, 17–43, 38/71, 144; 101/41, 57, 78, 93, 104, 114, 129, 130, 150, 193, 287; 100/93 P; 68/111

[56] References Cited

U.S. PATENT DOCUMENTS

| | | | |
|---|---|---|---|
| 651,424 | 6/1900 | McCarter et al. | 38/1 B |
| 1,635,610 | 7/1927 | Davis | 38/38 |
| 1,796,640 | 3/1931 | Waream et al. | 38/38 |
| 1,860,236 | 5/1932 | Davis | 38/40 |
| 1,870,894 | 8/1932 | Card | 38/36 |
| 2,022,073 | 11/1935 | Braun et al. | 38/40 X |
| 2,115,941 | 5/1938 | Castricone | 38/46 |
| 2,180,103 | 11/1939 | Engbrecht | 38/32 X |
| 2,241,539 | 5/1941 | Castricone | 38/38 |
| 2,472,656 | 6/1949 | Forse | 38/27 |
| 2,505,107 | 4/1950 | Forse | 38/41 |
| 2,521,708 | 9/1950 | Foster | 38/36 X |
| 3,084,462 | 4/1963 | Purpura | 38/36 |
| 3,279,106 | 10/1966 | Tucker | 38/40 |
| 3,640,007 | 2/1972 | Richterkessing | 38/41 |
| 3,757,440 | 9/1973 | Fresard et al. | 38/17 |
| 3,986,281 | 10/1976 | Darwin | 38/17 |
| 4,063,376 | 12/1977 | Horiuchi | 38/41 |
| 4,300,296 | 11/1981 | Hochstrasser | 38/27 X |
| 4,490,930 | 1/1985 | Jimenez et al. | 38/32 |
| 4,553,343 | 11/1985 | Primati et al. | 38/33 |
| 4,642,921 | 2/1987 | Primati | 38/36 |
| 4,809,450 | 3/1989 | Hochstrasser et al. | 38/36 |
| 4,843,745 | 7/1989 | Oberley | 38/34 |

*Primary Examiner*—Werner H. Schroeder
*Assistant Examiner*—Ismael Izaguirre
*Attorney, Agent, or Firm*—Kane, Dalsimer, Sullivan, Kurucz, Levy, Eisele and Richard

[57] ABSTRACT

A portable ironing press uses a compression spring to generate pressure between two pivotable plates for smoothing out a garment. The press includes a chain-and-gear arrangement to selectively apply the pressure of the spring to the plates.

11 Claims, 6 Drawing Sheets

PORTABLE IRONING PRESS INCLUDING CHAIN, GEAR, AND SPRING ARRANGEMENT, FOR PRESSING ARTICLES

BACKGROUND OF THE INVENTION

A. Field of Invention

This invention pertains to an ironing press for pressing clothes, and more particularly, a portable ironing press wherein pressure between two plates is developed mechanically in a safe and efficient manner.

B. Description of the Prior Art

Ironing presses are known in the art which are made small enough, so that they can be transported easily from place to place, and stored when not in use. Typically such devices must be capable of generating a large pressure between two plates in a close position, without exposing the user to this pressure. Furthermore, the pressure must be developed mechanically, i.e. without the use of hydraulic, pneumatic, or electrical devices which require complicated structures and add to the weight and overall cost of the device. However, until the present invention, no such devices have been made successfully.

For example, U.S. Pat. No. 4,642,921 discloses a portable iron in which complicated hook arrangements are used as a safety means. U.S. Pat. No. 4,490,930 requires complicated flexible roller tracks.

OBJECTIVE AND SUMMARY OF THE INVENTION

In view of the above-mentioned disadvantages of the prior art, an objective of the present invention is to provide a portable ironing press which develops sufficient pressure using relatively simple mechanical means.

A further objective is to provide an ironing press which can be made of inexpensive components.

Yet a further objective is to provide a safe, yet reliable device.

Other objectives and advantages of the invention shall become apparent from the following description of the invention. Briefly, an ironing press constructed in accordance with this invention comprises a base with a base plate, an arm rotatably disposed on said base and having an arm plate, and spring means for selectively applying pressure therebetween. A chain-and-gear means is used to transfer the force generated by the spring means to the plates in response to the rotation of the arm.

DETAILED DESCRIPTION OF THE INVENTION

Figure 1:
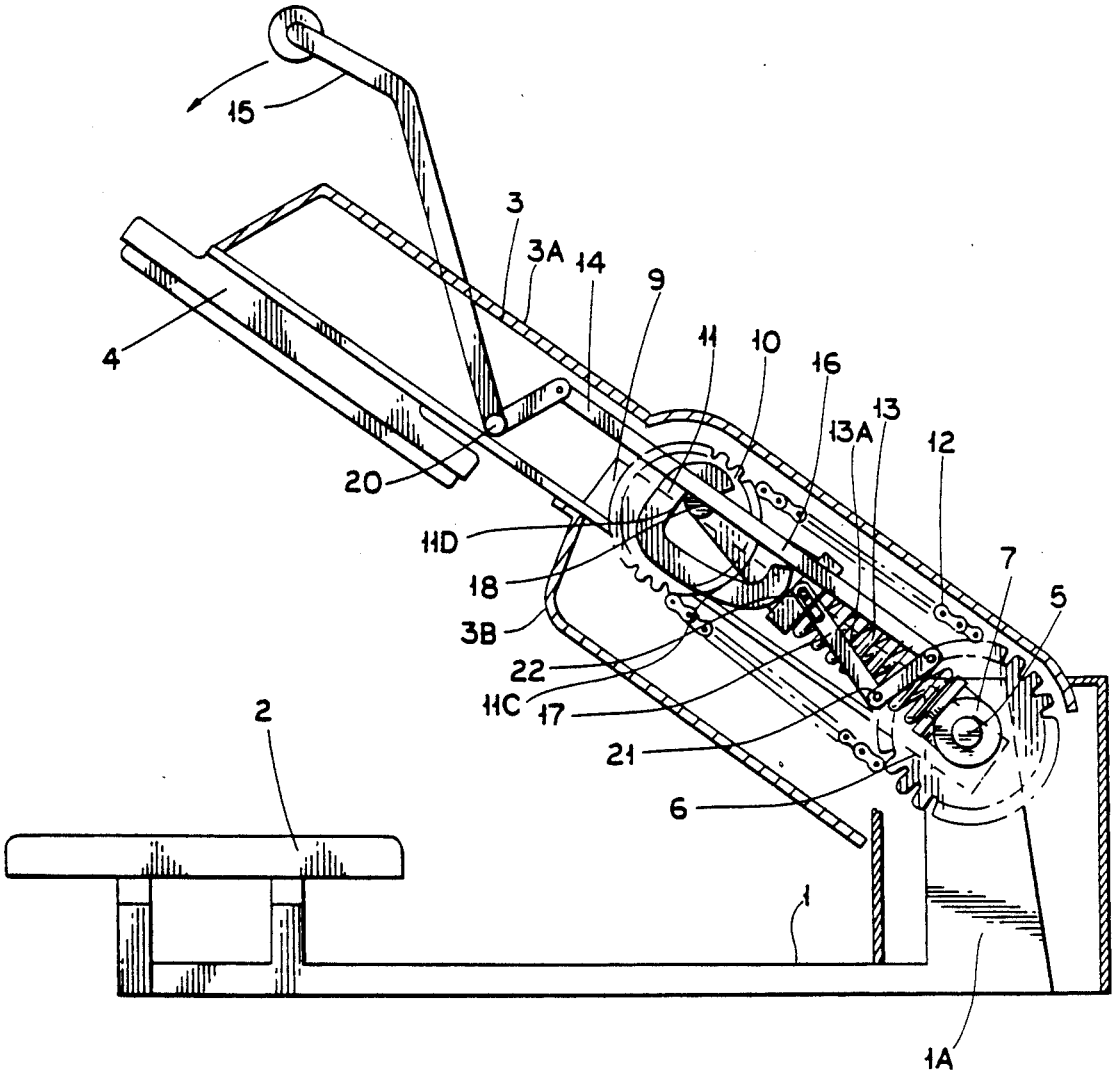
FIG. 1 shows a cross-sectional side view of an ironing press constructed in accordance with this invention, said press being in an open position.

Referring now to the drawings, an ironing press constructed in accordance with this invention consists of a base 1 with a stationary plate 2. The press also has a pivotable arm 3 with another plate 4. Plates 2 and 4 are fabric-coated and can be superposed so that when clothing is placed therebetween, pressure between the arm and base smooth the clothing. The press may also include electric heating means disposed in one or both plates 2, 4. These heating means are well known in the art and have been omitted for the sake of clarity.

Arm 3 includes a housing having an upper section 3A and a lower section 3B which hide and protect the mechanism used to generate pressure between plates 2, 4 as described below.

Base 1 includes an upright 1A which supports a fixed pin 5. A toothed gear 6 is mounted and secured on pin 5 so that it cannot rotate. Pin 5 also supports a spring cam rotatably mounted thereon. Cam 7 supports a coil spring 13 extending away from the cam. A spring bar 13A is disposed within the spring 13 and attached to cam 7 to maintain the alignment of the spring 13.

Figure 4:
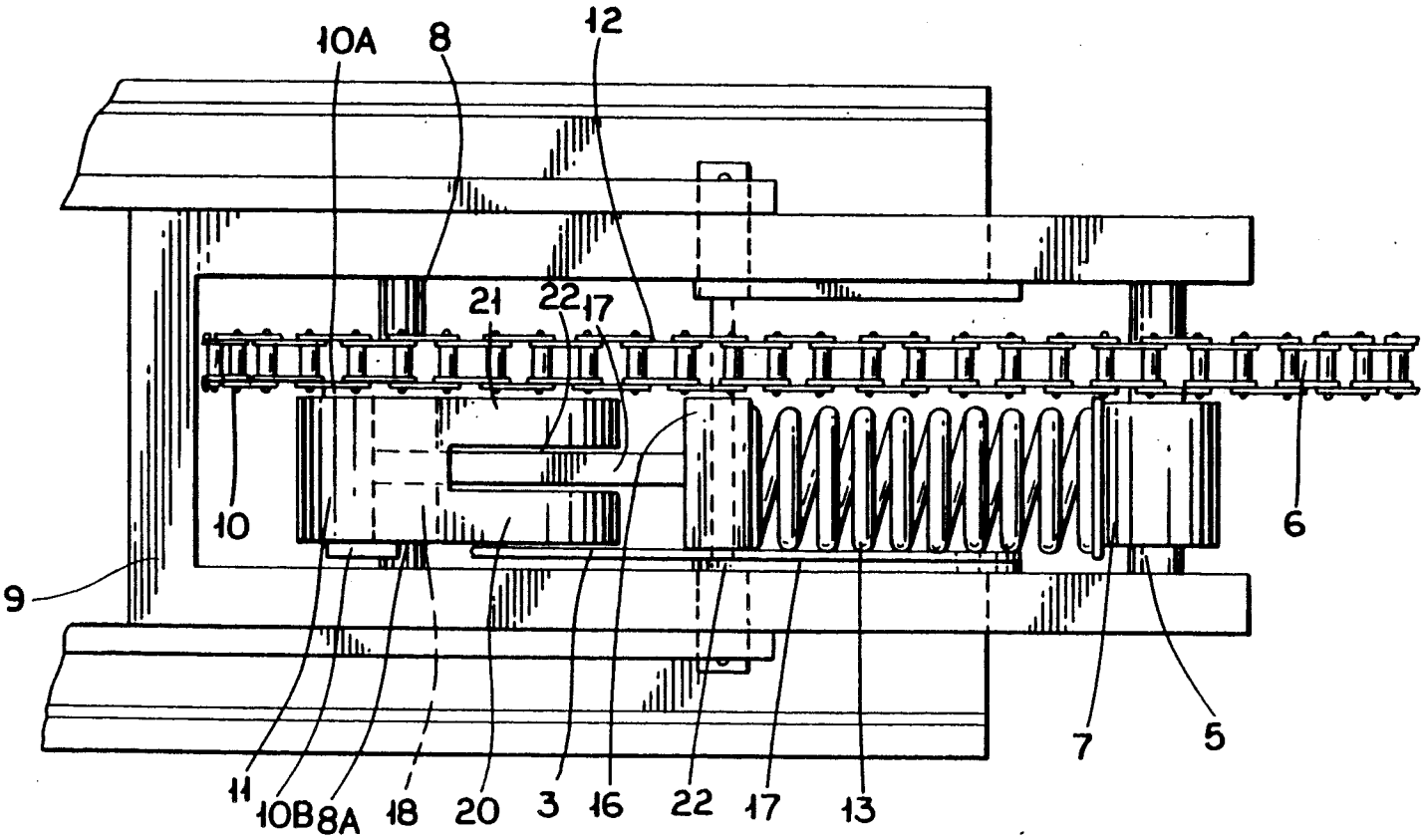
FIG. 4 shows a sectional top view of the press of FIG. 2.
Figure 5:
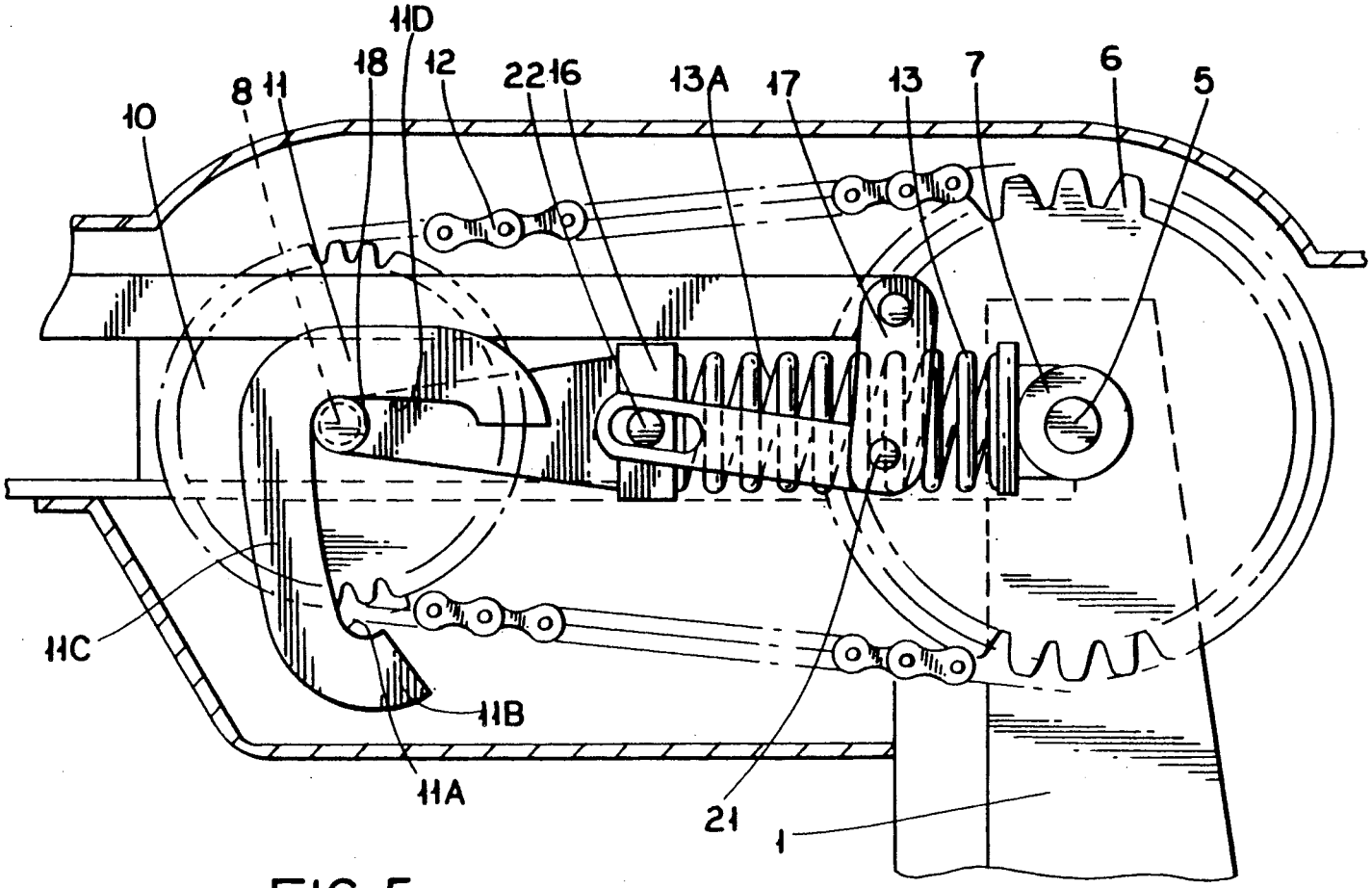
FIG. 5 shows an enlarged portion of the press of FIG. 2.

A carrier member 9 is disposed inside the housing 3 and is rotatably mounted on pin 5 to support arm 3. A pivot pin 8 is secured to member 9 as shown in FIG. 4, which supports a toothed gear 10 rotatable with respect to member 9. An L-shaped cam 11 is securely mounted on one side to gear 10, for example, by welding 10A, and on the other is pivotally mounted on member 9 by a pin 8A coaxial with pin 8. Pin 8A is mounted on cam 11 through an extension 10B welded to cam 11. The two toothed gears 6, 10 are coupled by a chain 12.

Spring 13 is provided at the end opposite cam 7 with a spring head 16 terminated by a roller 18. The roller 18 can slide along the inside surface 11A of cam 11. Spring head 16 is also provided with a pin 22. The purpose of this pin is explained below.

Figure 3:
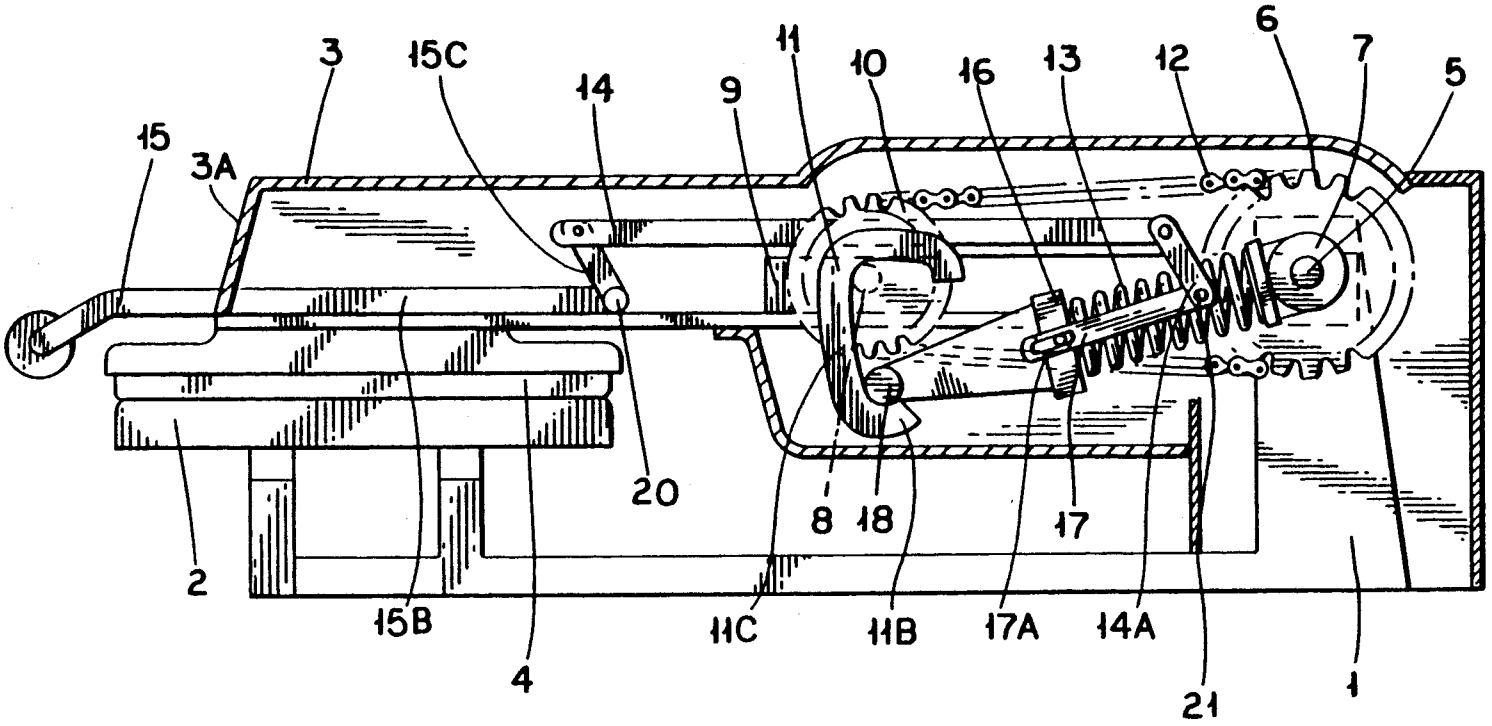
FIG. 3 shows a side-sectional view of the pres of FIGS. 1 and 2 in a closed position.
Figure 6:
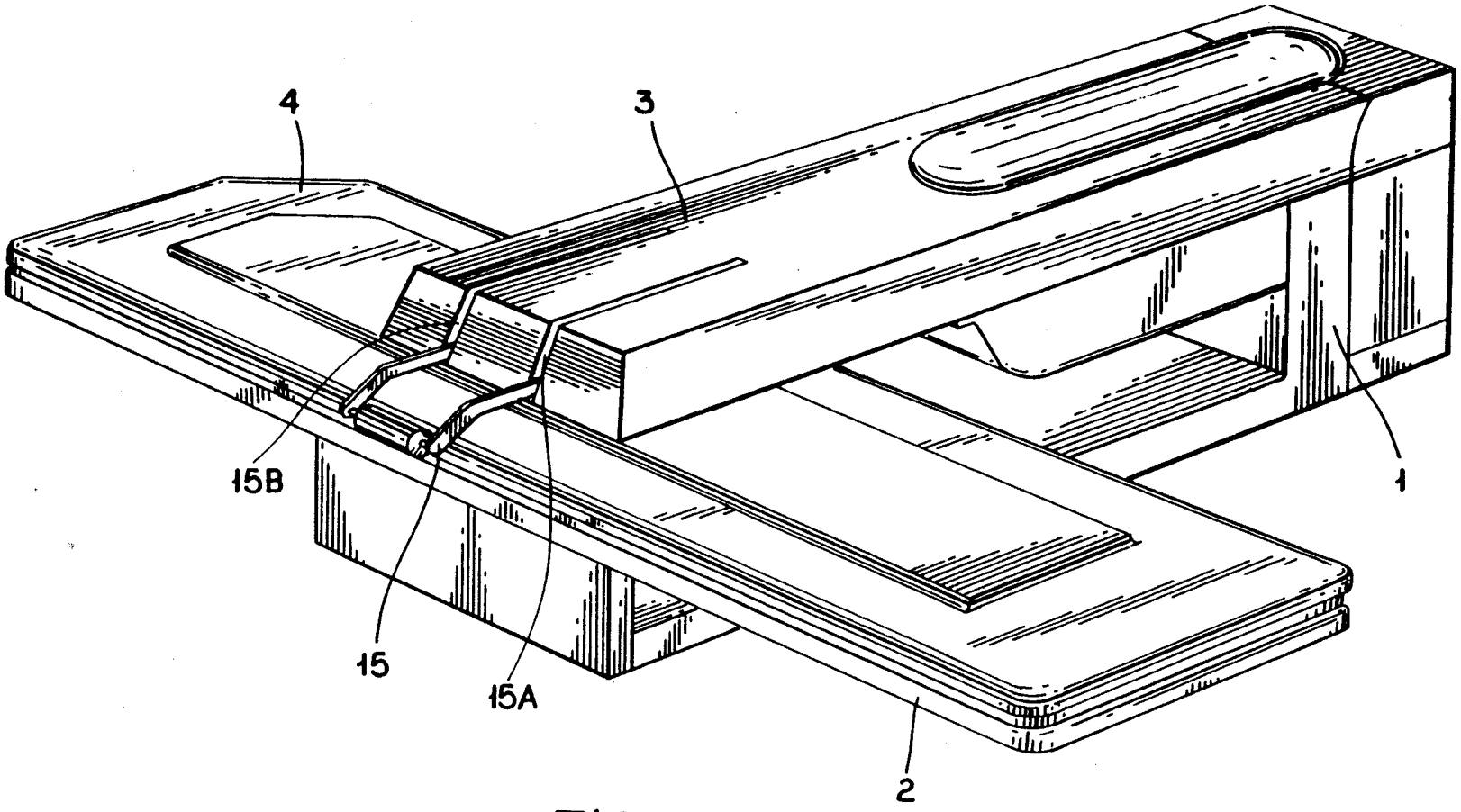
FIG. 6 shows an isometric view of the press.

As shown in FIG. 6, arm 3 also includes a U-shaped handle 15 extending outwardly through a pair of slots 15A. Each arm of the handle 15, such as arm 15B shown in FIG. 3 is pivotally attached by a pin 20 to housing section 3A. Rigidly attached to arm 15B is an extension 15C which is pivotally connected to an end of a connecting rod 14. The other end of rod 14 is pivotally connected to an end of an extension 14A. The other end of extension is rigidly connected by pin 21 to one end of a rod 17. Pin 21 is rotatably mounted on member 9. The opposite end of rod 17 has a longitudinal slot 17A. It should be understood there are two connecting rods 14, extensions 14A, and rods 5, are for each arm 15A, 15B, with pin 22 extending through the slot of each arm 17.

As seen from FIG. 4, the lower portion of cam 11 is split into two sections 20, 21 with an opening 22 therebetween. Spring head 17 is disposed in this opening so that it does not interfere with the movement of cam 11.

The ironing press described above operated as follows. Normally, arm 3 is in the open position shown in FIG. 1. In this position, handle 15 extends above housing 3A and pin 18 is resting on upper surface 110 of cam 11. Furthermore, section 11C of cam 11 extends substantially in parallel with connecting rod 14. After a garment is disposed on plate 2, arm 3 and handle 15 are pivoted together counterclockwise by an operator until the intermediate position in FIG. 2. During the transition from the open to the intermediate position, because gear 6 is stationary, chain 10 forces gear 11 to turn clockwise. The chain 10 and gears 6 and 10 are dimensioned and arranged so that between the open and the intermediate positions, gear 10 rotates clockwise by about 90°. As a result, L-shaped cam 11 also rotates so that in the intermediate position, section 11C is substantially normal to connecting rod 14 and pin 18 travels along surface 11D until it reaches surface 11A. In the intermediate position, plates 2 and 4 are in contact with each other.

Figure 2:
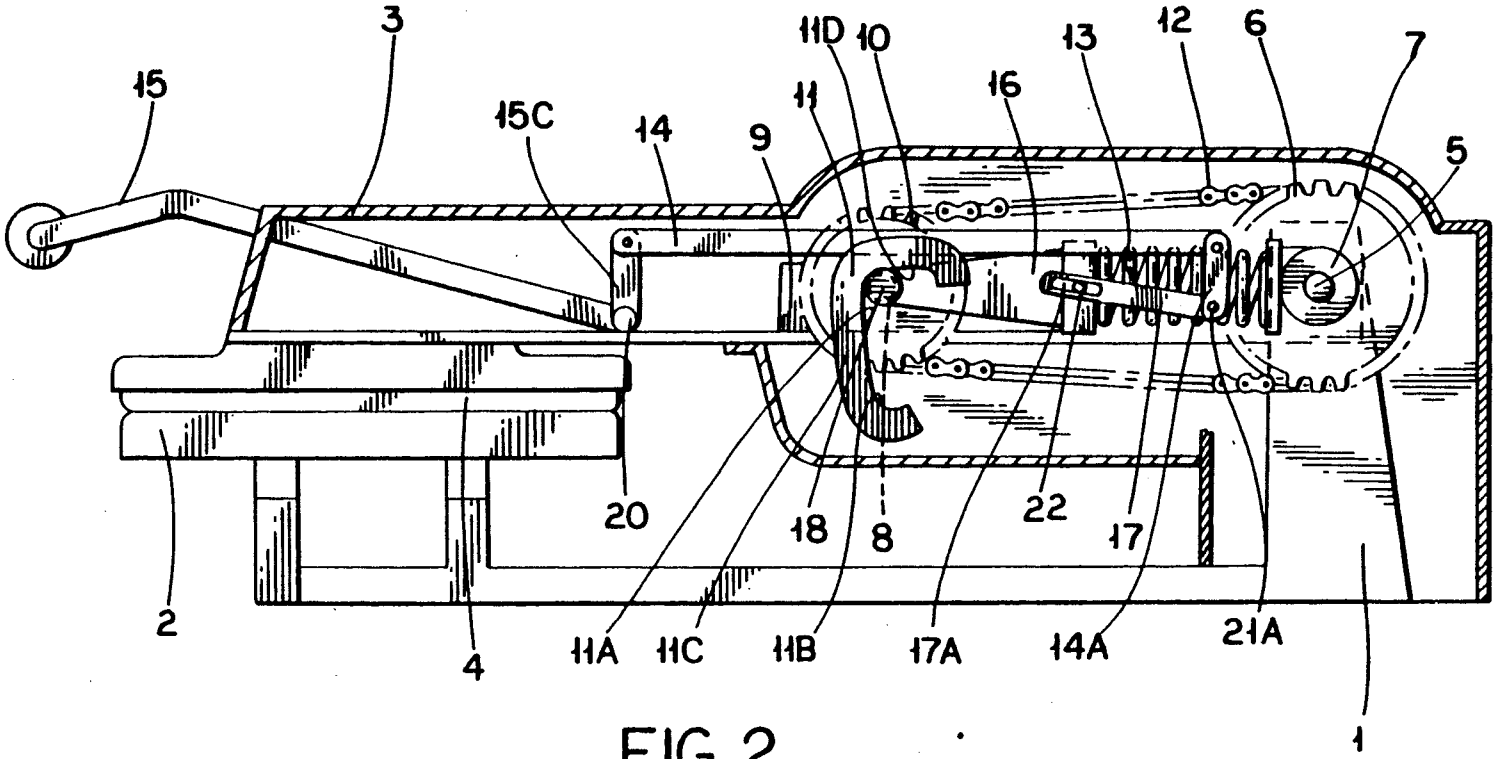
FIG. 2 shows a side-sectional view of the press of FIG. 1 in an intermediate position.

After the intermediate position of FIG. 2 is reached, further pivoting of handle 15 counterclockwise forces it to rotate with respect to arm 3, since arm 3 cannot pivot anymore due to the contact between the plates 2 and 4. As handle 15 turns counter-clockwise, extension 15C pulls connecting arm 14 toward handle 15. The connecting arm 14 in turn pivots extension 14A, which in response, turns arm 17 downward. The slot 17A then forces the spring 13 with its head 16 to turn counter-clockwise also until the position in FIG. 3 is reached. At the same time roller 18 travels along surface 11A until it reaches its bottom. The cam 11 has an extension 11B which insures that the roller 18 does not jump out of place. Spring 13 is under constant compression throughout this operation. In the position of FIG. 3, the force of spring 3 applies a large clockwise torque on gear 10 urging the arm 3 to turn clockwise. Since the gear 10 cannot rotate because of chain 12 and fixed gear 6, the torque exerted 15 by the spring 13 is transferred through cam 11, gear 10, and chain 12 to arm 3 and forces plate 4 downward against plate 2, thereby smoothing the garment.

When the user moves the handle 15 upward, the sequence described above is reversed. First, the handle 15 is lifted with respect to arm 3, turning spring 13 clockwise towards the position of FIG. 2. Thereafter, the whole arm 3 rotates clockwise, allowing gear 10 to turn counter-clockwise until pin 18 under the force of spring 13 snaps on surface 11D and the arm 3 reaches the open position of FIG. 1.

Obviously numerous modifications can be made to this invention without departing from its scope as defined in the appended claims.

I claim:

1. An ironing press comprising:

a base with a base plate;

an arm with an arm plate, said arm being pivotable between a first position wherein said plates are separated from each other and a second position wherein said plates cooperate to form a pressing zone for ironing garments;

a chain-and-gear arrangement coupled between said arm and said base;

spring means for generating a pressure; and coupling means for selectively applying said pressure to said plates through said chain-and-gear arrangement when said arm is in said second position.

2. The ironing press of claim 1 wherein said chain-and-gear arrangement includes a base gear mounted on said base, an arm gear mounted on said arm and a continuous chain engaging said base and arm gears.

3. The ironing press of claim 2 wherein said base gear is fixed and said arm gear is rotatable.

4. The ironing press of claim 1 further including handle means for selectively applying said pressure from said spring means to said chain-and-gear arrangement.

5. The ironing press comprising:

a base with a base plate;

an arm rotatably mounted on said base, and having an arm plate;

spring means disposed between said arm and said base for generating a spring force;

a chain-and-gear arrangement disposed between said arm and said base;

coupling means disposed on said arm for selectively transferring said spring force from said spring through said chain-and-gear arrangement to said arm plate; and handle means pivotally mounted on said arm for rotating said arm between an open position in which said plates are separated, an intermediate position wherein said plates are in contact, said handle being rotatable to a closed position to activate said coupling means for transferring said force to said arm plate.

6. The press of claim 5 wherein said chain-and-gear arrangement includes a base gear affixed to said base, an arm gear rotatably mounted on said arm, and a continuous chain engaging said gears.

7. The press of claim 6 wherein said spring means includes a spring bar rotatably mounted on said base, a coil spring having a first end mounted on a said spring cam, and a second end mounted on a spring head.

8. The press of claim 7 wherein said coupling means includes a coupling cam coupled to said arm gear, and a coupling arm extending between said handle means and said spring head.

9. The press of claim 8 wherein said spring head engages said coupling cam.

10. An ironing press comprising:

a base with a base plate and an upright, said upright holding a fixed base pin and a base gear secured to said base pin;

an arm rotatably mounted on said base pin, said arm including a rotatable arm gear, a chain engaging said arm gear and said base gear, and a coupling cam secured to said arm gear;

spring means including a spring cam rotatably mounted on said base pin, a coil spring having a first end coupled to said spring cam, and a second end coupled with a spring head engaging said coupling cam;

coupling means for selectively rotating said spring means between a first spring position and a spring second position with respect to said base pin; and handle means pivotally mounted on said arm and connected to said coupling means for selectively pivoting said spring means.

11. The press of claim 10 wherein said coupling cam, and said base pin are constructed and arranged to compress said coil spring at least in said second spring position.

* * * * *